US007682189B2

(12) United States Patent
Yamaguchi et al.

(10) Patent No.: US 7,682,189 B2
(45) Date of Patent: Mar. 23, 2010

(54) DUMMY CONNECTOR

(75) Inventors: Hiroaki Yamaguchi, Aichi (JP); Takahiro Ishiyama, Toyota (JP)

(73) Assignee: Kabushiki Kaisha Tokai Rika Denki Seisakusho, Aichi (JP)

( * ) Notice: Subject to any disclaimer, the term of this patent is extended or adjusted under 35 U.S.C. 154(b) by 0 days.

(21) Appl. No.: 12/343,355

(22) Filed: Dec. 23, 2008

(65) Prior Publication Data

US 2009/0181576 A1 Jul. 16, 2009

(30) Foreign Application Priority Data

Jan. 10, 2008 (JP) ..... 2008-003423

(51) Int. Cl.
*H01R 13/73* (2006.01)

(52) U.S. Cl. ..... 439/557; 439/148

(58) Field of Classification Search ..... 439/148, 439/350, 352, 353, 357, 552, 557, 638
See application file for complete search history.

(56) References Cited

U.S. PATENT DOCUMENTS 5,246,380 A * 9/1993 Kodama ..... 439/354
5,554,044 A * 9/1996 Nishide ..... 439/352
5,774,611 A * 6/1998 Nagase et al. ..... 385/58
5,785,546 A * 7/1998 Hamai et al. ..... 439/354
5,902,155 A * 5/1999 Polgar et al. ..... 439/680
5,980,297 A * 11/1999 Sugie ..... 439/354
6,273,752 B1 * 8/2001 Martin et al. ..... 439/540.1
6,478,472 B1 * 11/2002 Anderson et al. ..... 385/53
7,112,090 B2 * 9/2006 Caveney et al. ..... 439/540.1
2002/0025712 A1 * 2/2002 Mochizuki et al. ..... 439/357

FOREIGN PATENT DOCUMENTS

JP 10-247549 A 9/1998

* cited by examiner

*Primary Examiner*—Thanh-Tam T Le
(74) *Attorney, Agent, or Firm*—Roberts Mlotkowski Safran & Cole, P.C.; Thomas W. Cole

(57) ABSTRACT

A dummy connector includes a main body including an opening into which a real connector is to be inserted, and a first holding portion and a second holding portion installed respectively on surfaces which face to each other in the opening, and for holding the real connector by sandwiching from a direction of height of the real connector.

8 Claims, 6 Drawing Sheets

DUMMY CONNECTOR

CROSS-REFERENCE TO RELATED APPLICATIONS

The present application is based on Japanese patent application No. 2008-003423, filed on Jan. 10, 2008, the entire contents of which are incorporated herein by reference.

BACKGROUND OF THE INVENTION

1. Field of the Invention

This invention relates to a dummy connector and, in particular, to a dummy connector having a structure that is capable of holding any real connector having several varieties of widths corresponding to different numbers of terminals by a single main body.

2. Description of the Related Art

Conventionally, a connector caps are known, the connector caps being formed corresponding to the shape of connector housing of a counterpart connector to be connected by the connector caps (refer to JP-A-1998-247549 (patent document 1).

The connector cap has a connector housing to be connected to the counterpart connector so that it can save the trouble of fabricating a mold and it can be produced at a low price and in a large variety. Further, the connector cap uses electrical wires with terminals connected to the counterpart connector as a joining tool to be joined to the counterpart connector so that it can be prevented from being lost even if the connector cap is removed from the counterpart connector.

However, when the conventional connector cap is used for a vehicle harness, the counterpart connector to which the connector cap is connected can not be fixed to the vehicle, thus there has been a problem that unpleasant noise occurs by vibration of the vehicle and the connector cap should be prepared corresponding to the counterpart connector respectively so as to raise the increase in cost.

SUMMARY OF THE INVENTION

It is an object of the invention to provide a dummy connector having a structure that is capable of holding any real connector comprising several varieties of widths corresponding to different numbers of terminals by a single main body.

(1) According to one aspect of the invention, a dummy connector, includes:

a main body including an opening into which a real connector is to be inserted; and a first holding portion and a second holding portion installed respectively on surfaces which face to each other in the opening, and for holding the real connector by sandwiching from a direction of height of the real connector.

(2) According to another aspect of the invention, a dummy connector, includes:

a main body including an opening into which a real connector is to be inserted; and a first holding portion and a second holding portion installed respectively on surfaces which face to each other in the opening, and for holding the real connector by sandwiching from a direction of height of the real connector, wherein:

the first holding portion has a first concave portion formed based on a lock portion installed in the real connector, and when the first holding portion sandwiches a base portion of the real connector having a terminal between the second holding portion, so as to hold the real connector.

(Advantages of the invention)

According to the above-mentioned constitution, any real connector comprising several varieties of widths corresponding to different numbers of terminals can be held.

BRIEF DESCRIPTION OF THE DRAWINGS

The preferred embodiments according to the invention will be explained below referring to the drawings, wherein.

DETAILED DESCRIPTION OF THE PREFERRED EMBODIMENTS (Structure of Vehicle)

Figure 1A:
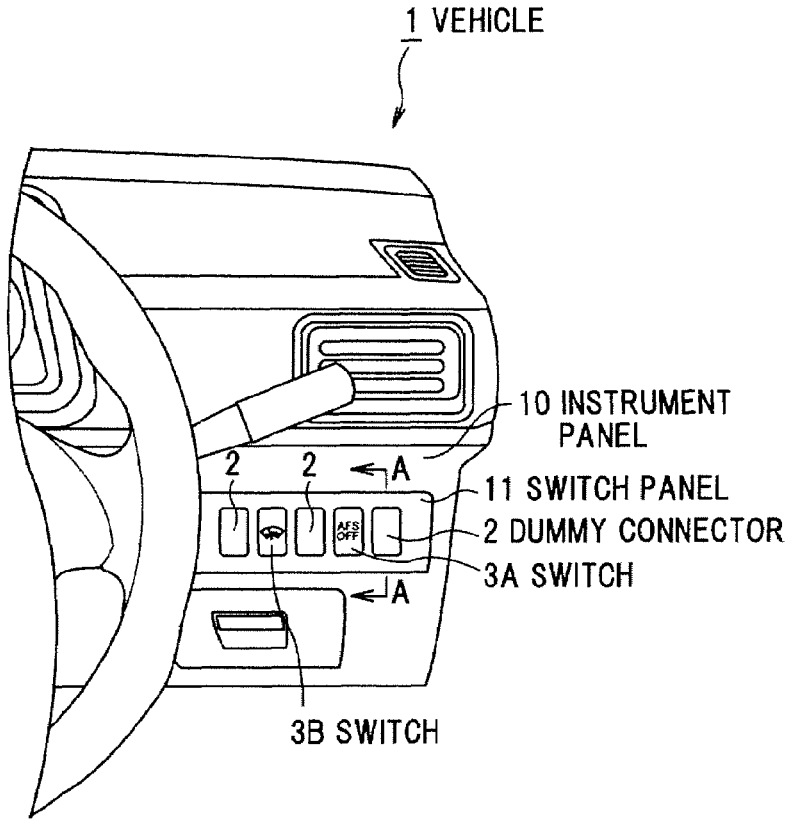
FIG. 1A is a schematic view showing a vehicle inside mounting a dummy connector according to an embodiment of the invention.
Figure 1B:
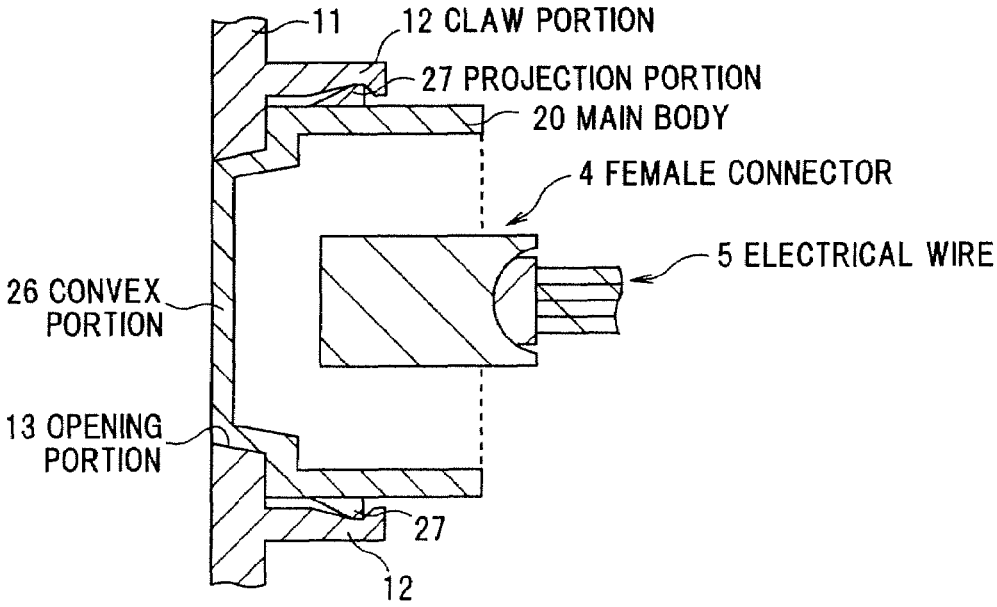
FIG. 1B is a cross-sectional view taken along the line A-A in FIG. 1A showing vicinity of an instrument panel.

FIG. 1A is a schematic view showing a vehicle inside mounting a dummy connector according to an embodiment of the invention, and FIG. 1B is a cross-sectional view taken along the line A-A in FIG. 1A showing vicinity of an instrument panel.

Hereinafter, an embodiment in a case that a dummy connector according to the invention is mounted on a vehicle will be explained.

Vehicle 1 includes an instrument panel 10 on which meters, gauges and switches located in front of a driver seat are installed, the instrument panel 10 having a switch panel 11 which is a decoration board for mounting switches 3A, 3B and a dummy connector 2. In the switch panel 11, as one example, two dummy connectors 2 and the switches 3A, 3B are mounted. The switch 3A is, for example a switch that controls a movement of an intelligent AFS (Adaptive Front-Lighting System) depending on state of running of the vehicle 1 and for automatically moving an illumination axis of a head lamp in horizontal direction, and the switch 3B is a switch that controls a movement of a front window having heating coils herein. The dummy connector 2 is a connector to be mounted in place of switches, for example, when switches of an electronic device which can be installed as an option extra (for example, audio device, fog lamp, rear wiper and the like) are not mounted on the switch panel 11.

As shown in FIG. 1B, the switch panel 11 includes a claw portion 12 and an opening portion 13, wherein the claw portion 12 is a portion that is connected to the projection portion 27 of the dummy connector 2 so as to fix the dummy connector 2 to the switch panel 11, and the opening portion 13 is a portion into which the convex portion 26 of the dummy connector 2 is inserted.

(Structure of Dummy Connector 2)

Figure 2A:
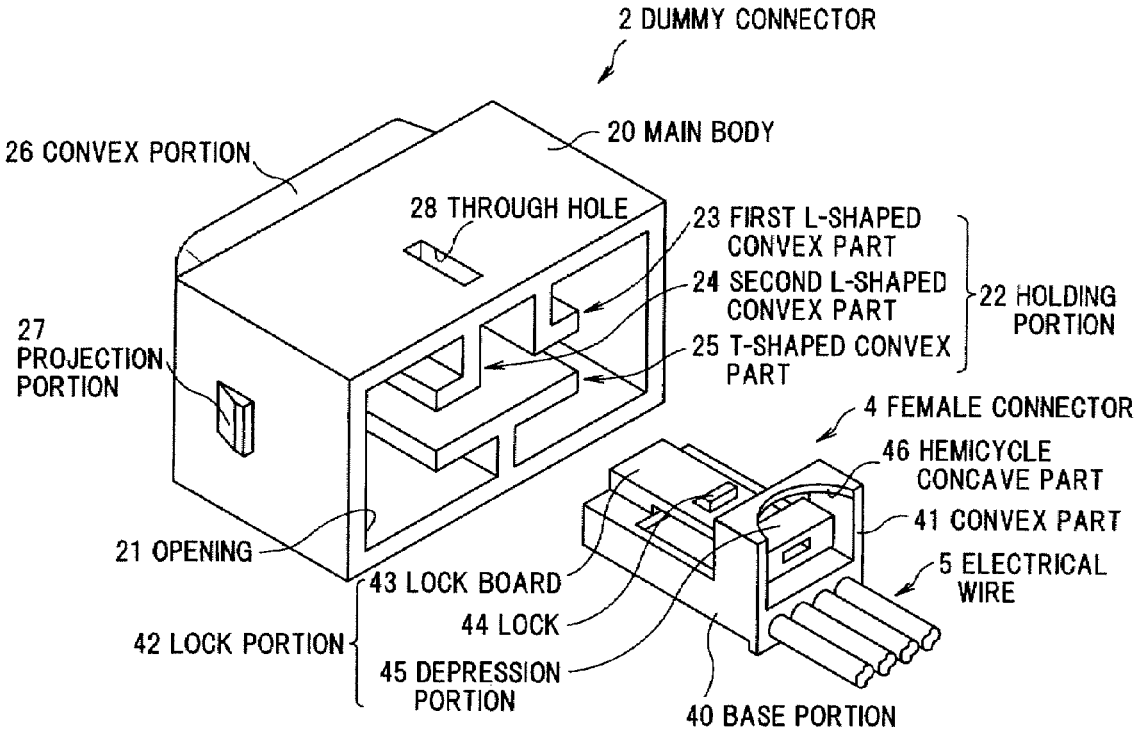
FIG. 2A is a perspective view showing a dummy connector according to an embodiment of the invention and a female connector.
Figure 2B:
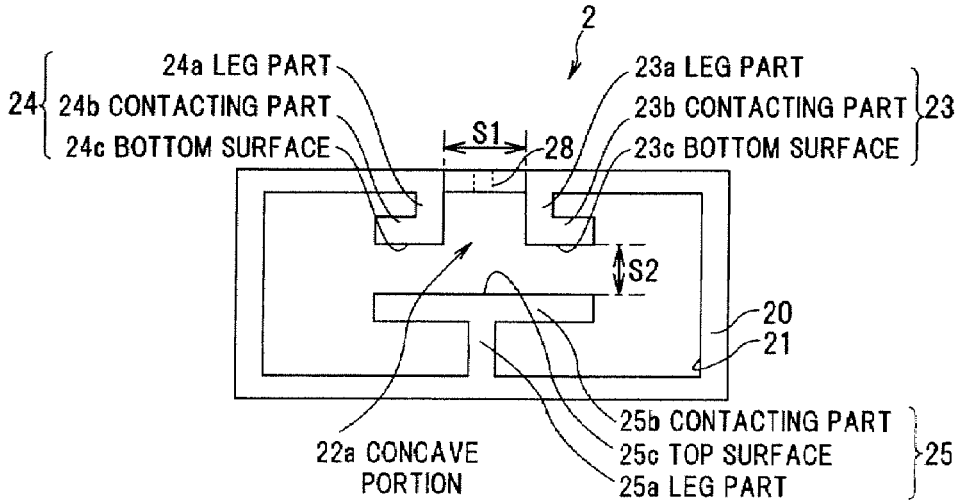
FIG. 2B is a back view showing a dummy connector according to an embodiment of the invention.
Figure 3:
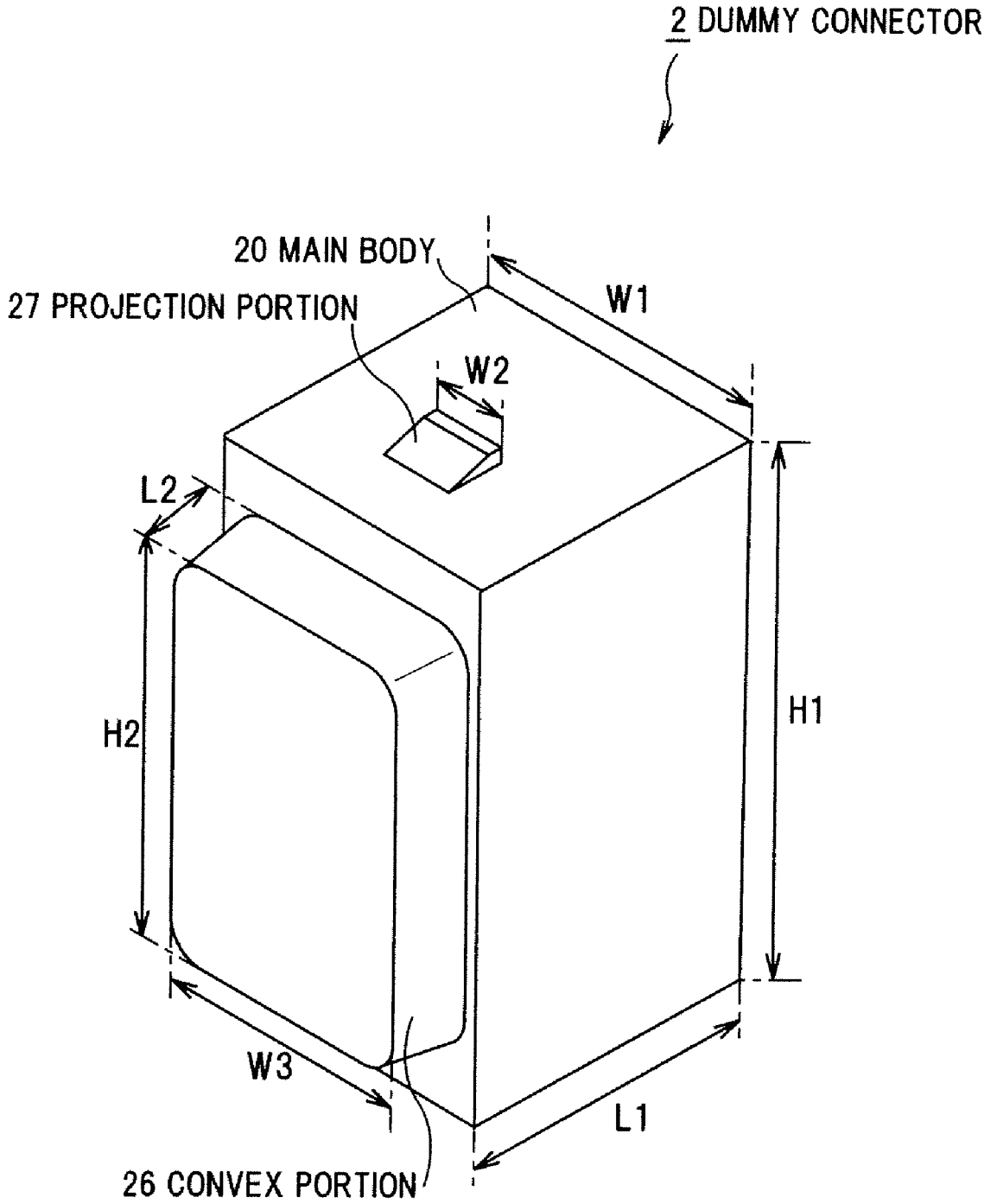
FIG. 3 is a perspective view showing a dummy connector according to an embodiment of the invention.

FIG. 2A is a perspective view showing a dummy connector according to an embodiment of the invention and a female connector, FIG. 2B is a back view showing a dummy connector according to an embodiment of the invention and FIG. 3 is a perspective view showing a dummy connector according to an embodiment of the invention. FIG. 2B shows a view seen from the side of female connector 4 to be inserted into the opening 21.

The dummy connector 2 is formed, as one example by injection molding from ABS resin, has a rectangular shape, and has an outline of structure that includes in one side a main body 20 having the opening 21 into which the female connector 4 is inserted and a holding portion 22 for holding the female connector 4 inserted into the opening 21.

The main body 20 of the dummy connector 2 has an outline of structure that includes a convex portion 26 to be inserted into the opening portion 13 of the switch panel 11, a projection portion 27 to be connected to the claw portion 12 of the switch panel 11 and a through hole 28 as a second concave portion passing through the main body 20. Further, with regard to the size, as one example, the main body 20 has a dimension that width W1 is 23.2 mm, height H1 is 38.2 mm (40 mm when the projection portion 27 is included) and depth L1 is 30.5 mm, the projection portion 27 has a dimension that width W2 is 5 mm, and the convex portion 26 has a dimension that width W3 is 19.3 mm, height H2 is 30.3 mm and depth L2 is 9.1 mm. Further, the through hole 28 is not particularly limited in a hole structure passing through the main body 20 and can be a structure to which a lock 44 to be hereinafter described can be connected.

The holding portion 22 of the dummy connector 2 has an outline of structure that includes first and second L-shaped convex parts 23, 24 as a first holding portion having an almost L-shaped structure and rising from the upper surface of the opening 21 to the center direction of the opening 21, and a T-shaped convex part 25 as a second holding portion having an almost T-shaped structure and rising from the lower surface of the opening 21 facing to the first and second L-shaped convex parts 23, 24 to the center direction of the opening 21.

As shown in FIG. 2B, the first and second L-shaped convex parts 23, 24 have an outline of structure that includes leg parts 23*a*, 24*a* rising vertically from the upper surface of the opening 21, and contacting parts 23*b*, 24*b* formed on the leg parts 23*a*, 24*a* so as to be in parallel with the long side of the opening 21. The contacting parts 23*b*, 24*b* have bottom surfaces 23*c*, 24*c* to contact the female connector 4, and a concave portion 22*a* as a first concave portion is formed by the leg parts 23*a*, 24*a*. Since a lock board 43 of the female connector 4 to be hereinafter described is inserted into the concave portion 22*a*, the distance S1 between the leg parts 23*a* and the leg parts 24*a* is set, as one example, to 7 mm. This is due to making the distance S1 responsive to the female connector 4 having the lock board 43 of 7 mm in width, but the distance S1 is not particularly limited in this and if the distance S1 is changed according to the size of the lock board 43 of the female connector 4, the concave portion 22*a* can be used in response to a large variety of the female connectors 4.

As shown in FIG. 2B, the T-shaped convex part 25 has an outline of structure that includes a leg part 25*a* rising vertically from the lower surface of the opening 21 facing to the first and second L-shaped convex parts 23, 24, and a contacting part 25*b* formed on the leg part 25*a* so as to be in parallel with the contacting parts 23*b*, 24*b*. The T-shaped convex part 25 has a top surface 25*c* to contact the female connectors 4. Further, as shown in FIG. 2B, the distance S2 between the bottom surfaces 23*c*, 24*c* and the top surface 25*c* is set, as one example, to 4.6 mm, this being based on the height of a base portion 40 of the female connectors 4. However, the distance S2 is not particularly limited in this and if the distance S2 is changed according to the shape of the connector to be inserted, the holding portion 22 can hold not only the female connector but also a male connector, and can be used for the female connector 4 having terminals formed in plural rows.

(Structure of Female Connector 4)

Figure 4:
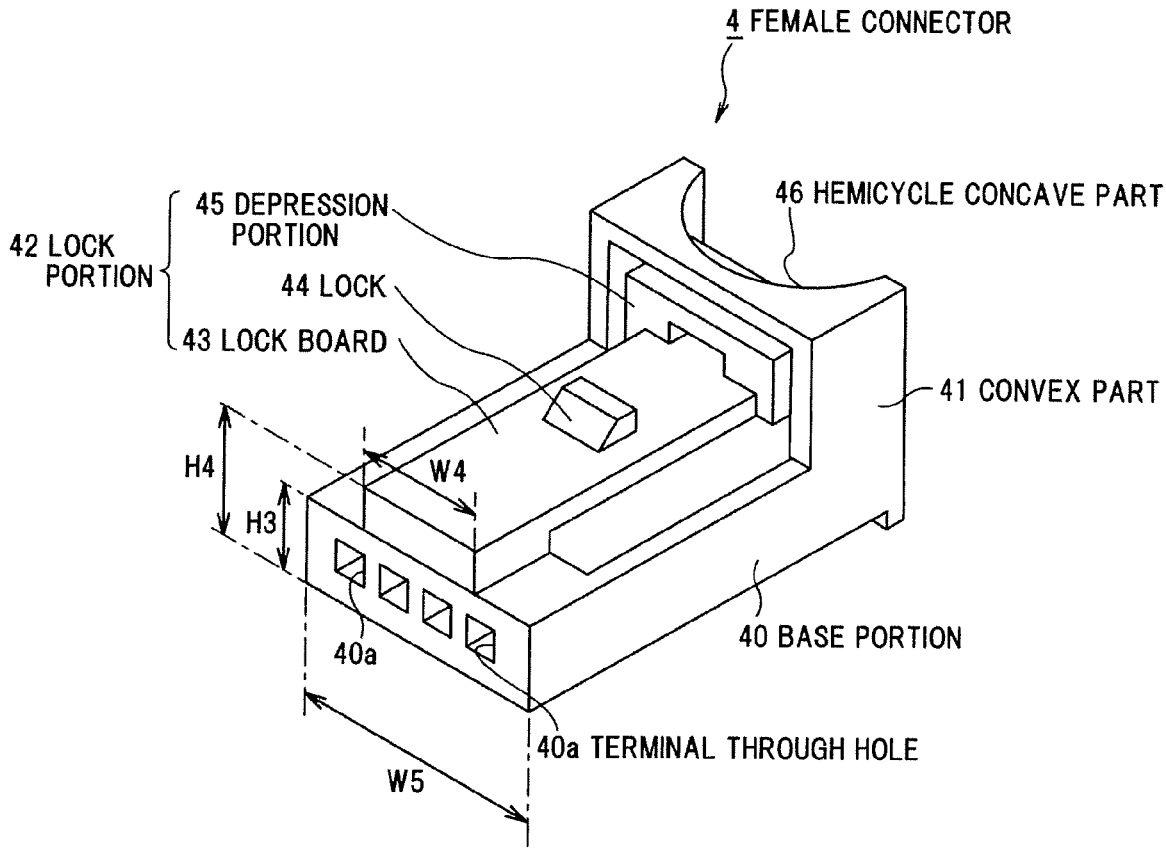
FIG. 4 is a perspective view showing a female connector used for a dummy connector according to an embodiment of the invention.

FIG. 4 is a perspective view showing a female connector used for a dummy connector according to an embodiment of the invention. The female connector 4 is, as one example, a connector to be connected to switches of an electronic device (not shown) to be mounted on the switch panel 11, and is connected to an ECU (Electronic Control Unit) (not shown) of the vehicle 1 through the electrical wire 5.

The female connector 4 is formed, as one example, by injection molding from PBT (Polybutylene terephthalate) resin, has a rectangular shape, and has an outline of structure that includes a base portion 40 having a plurality of terminal through holes 40*a* arranged in a row, into which the electrical wires 5 with a terminal at the top portion are inserted, a convex part 41 formed in an almost rectangular lychgate shape from the end of left side to the end of opposing right side of the base portion 40 and having a hemicycle concave part 46 with a shape formed like a fingertip, and a lock portion 42 to be hereinafter described.

The lock portion 42 has an outline of structure that includes a lock board 43 whose one end is fixed in the end of the base portion 40 and whose another end is free, a lock 44 disposed on the surface of the lock board 43 and being a projecting portion to be connected to a concave portion of a counterpart connector so as to fix the counterpart connector and the female connector, and a depression portion 45 disposed on the side of free end of the lock board 43. The lock board 43, when the depression portion 45 projecting to the hemicycle concave part 46 is depressed by a finger, elastically deforms downwards since one end of the lock board 43 is fixed to the base portion 40, and when the finger is released from the depression portion 45, the lock board 43 returns to the original position since force of restitution is exerted.

The height H3 of the base portion 40 of the female connector 4 is different according to the number of electrical wires 5 connected to the female connector 4, but as one example, it is 4.4 mm in the type that the terminal through holes 40*a* are arranged in a row. The height H4 Which increased height of the lock board 43 is 6.5 mm. The distance S2 between the bottom surfaces 23*c*, 24*c* and the top surface 25*c* shown in FIG. 2B is set to be larger than the height H3 so that the base portion 40 of the female connector 4 can be inserted, then it can be used in response to a large variety of the female connectors 4. Further, the width W4 of the lock board 43 is, as one example, 7 mm or 10 mm, and the concave portion 22*a* of the dummy connector 2 is corresponding to the width W4. The width W5 of the base portion 40 is different according to the number of terminals, but as one example, it is 4 mm in case of four terminals, and 13.2 mm in case of five terminals.

(Operation)

Hereinafter, an operation of a dummy connector in the embodiment of the invention will be explained in detail with reference to FIGS. 1 to 4 and FIGS. 5A to 5C to be hereinafter described.

Figure 5A:
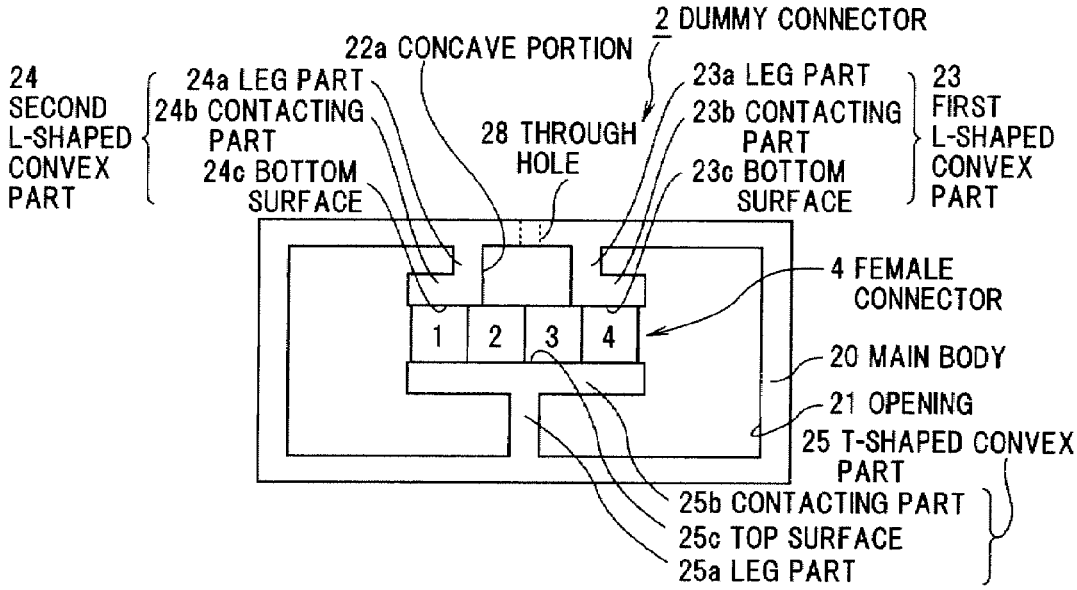
FIG. 5A is a schematic view showing a dummy connector according to an embodiment of the invention.
Figure 5B:
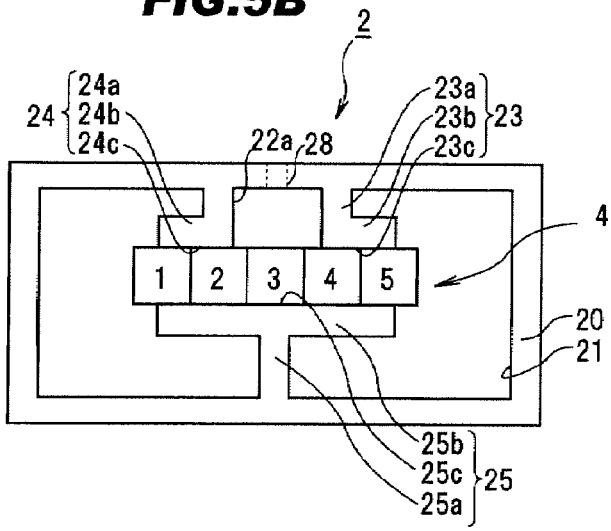
FIG. 5B is a schematic view showing a dummy connector according to an embodiment of the invention.
Figure 5C:
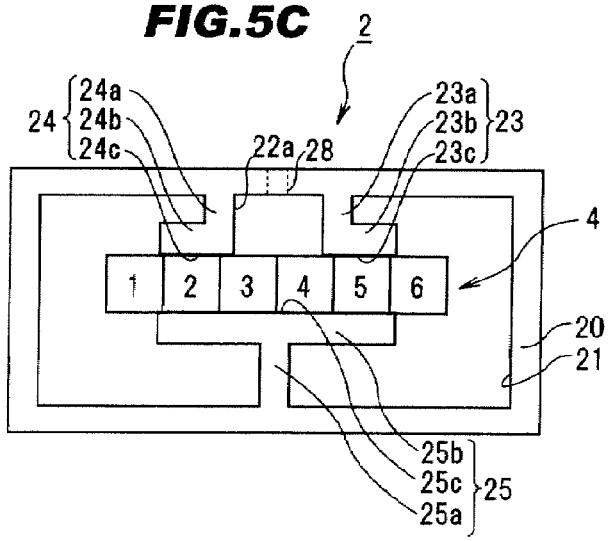
FIG. 5C is a schematic view showing a dummy connector according to an embodiment of the invention.

FIGS. 5A to 5C are schematic views showing a dummy connector according to an embodiment of the invention. In FIGS. 5A to 5C, the number of terminals in the female connector 4 is represented by the number (1 to 6) shown in the drawings so as to be easily understandable.

The base portion 40 of the female connector 4 is inserted into the space between the first and second L-shaped convex parts 23, 24 and the T-shaped convex part 25 of the dummy connector 2. Then, the lock portion 42 is inserted into the concave portion 22*a* formed by the first and second L-shaped convex parts 23, 24. The female connector 4 is further inserted into the dummy connector 2, then the slope of the lock 44 inclining to the insertion direction contacts the main body 20, and the lock board 43 is depressed by the main body 20 through the lock 44. The female connector 4 is furthermore inserted into the dummy connector 2, then the upper surface of lock 44 is gone ahead while being contacted with the upper surface of opening 21, and the lock 44 is connected to the through hole 28, and the base portion 40 of the female connector 4 is sandwiched between the first and second L-shaped convex parts 23, 24 and the T-shaped convex part 25 so that the female connector 4 is held in the dummy connector 2.

The height H1 of dummy connector 2 is larger than the width W5 of female connector 4 so that the dummy connector 2 can hold a large variety of the female connectors 4 corresponding to the width W5 being smaller than the height H1, such as the female connector 4 having four terminals shown in FIG. 5A, the female connector 4 having five terminals shown in FIG. 5B, and the female connector 4 having six terminals shown in FIG. 5C by a single main body 20.

(Advantage of Embodiment)

According to the above-mentioned embodiment, any female connector 4 having several varieties of widths corresponding to different numbers of terminals can be held by a single main body 20 so that the vehicle 1 can be prevented from occurring unpleasant noise while it is moving. Further, it is not necessary to prepare the dummy connector 2 in response to every female connector 4 having several varieties of widths corresponding to different numbers of terminals so that wrong assembly can be prevented and production cost can be reduced.

(Modification)

Figure 6A:
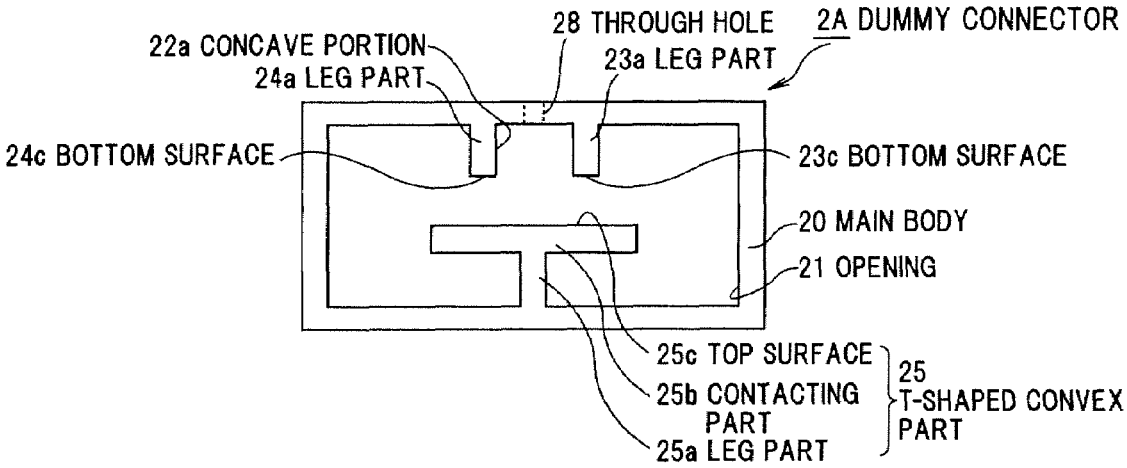
FIG. 6A is a schematic view showing a structure of holding portion of a dummy connector according to a modification of the invention.
Figure 6B:
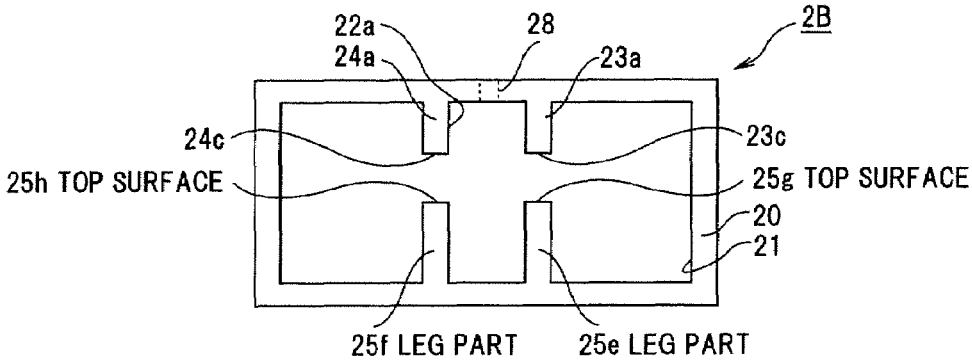
FIG. 6B is a schematic view showing a structure of holding portion of a dummy connector according to a modification of the invention.
Figure 6C:
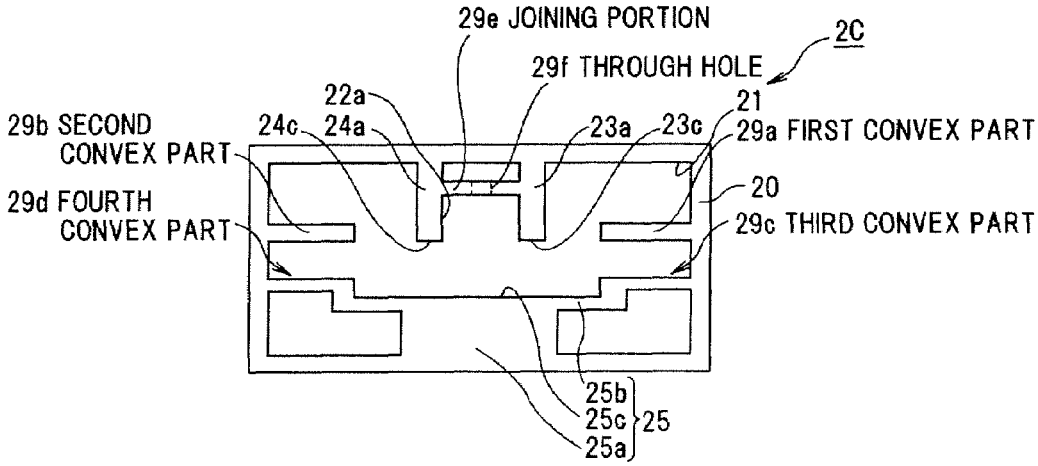
FIG. 6C is a schematic view showing a structure of holding portion of a dummy connector according to a modification of the invention.

FIGS. 6A to 6C are schematic views showing a structure of holding portion of a dummy connector according to a modification of the invention. Further, in the following description, with regard to components having the same construction and function as the above-mentioned embodiment has, the same references are used, and detail explanation is omitted. In the modification, the difference among the structures of holding portion 22 will be mainly described.

A dummy connector 2A shown in FIG. 6A has a structure that the first and second L-shaped convex parts 23, 24 shown in FIG. 2B have only the leg parts 23*a*, 24*a*, and has the leg parts 23*a*, 24*a* and T-shaped convex part 25 as the holding portion 22.

When the dummy connector 2A sandwiches the bottom surface and top surface of base portion 40 of female connector 4 between the bottom surfaces 23*c*, 24*c* and the top surface 25*c* and the lock portion 42 is inserted into the concave portion 22*a*, the lock 44 connects to the through hole 28 so that the dummy connector 2A can hold the female connector 4 stably.

A dummy connector 2B shown in FIG. 6B has leg parts 25*e*, 25*f* instead of the T-shaped convex part 25 shown in FIG. 6A, and has the leg parts 23*a*, 24*a*, 25*e*, 25*f* as the holding portion 22.

When the dummy connector 2B sandwiches the bottom surface and top surface of base portion 40 of female connector 4 between the bottom surfaces 23*c*, 24*c* and the top surfaces 25*g*, 25*h* and the lock portion 42 is inserted into the concave portion 22*a*, the lock 44 connects to the through hole 28 so that the dummy connector 2B can hold the female connector 4 stably.

A dummy connector 2C shown in FIG. 6C has the leg parts 23*a*, 24*a* and the T-shaped convex part 25 as the holding portion 22. Further, the dummy connector 2C has first to fourth convex parts 29*a* to 29*d* on the side surface of opening 21, and the third and fourth convex parts are connected to the T-shaped convex part 25. Furthermore, a joining portion 29*e* is formed between the leg parts 23*a*, 24*a*, and it has a through hole 29*f* to which the lock 44 of the female connector 4 is to be connected.

When the dummy connector 2C sandwiches the bottom surface and top surface of base portion 40 of female connector 4 between the bottom surfaces 23*c*, 24*c* and the top surface 25*c* and the lock portion 42 is inserted into the concave portion 22*a*, the lock 44 connects to the through hole 29*f*. The leg parts 23*a*, 24*a* and the T-shaped convex part 25 are strengthened by the first to fourth convex parts 29*a* to 29*d* and the joining portion 29*e* so that the dummy connector 2C can hold the female connector 4 stably.

Although the invention has been described with respect to the specific embodiments for complete and clear disclosure, the appended claims are not to be thus limited but are to be construed as embodying all modifications and alternative constructions that may occur to one skilled in the art which fairly fall within the basic teaching herein set forth.

What is claimed is:

1. A dummy connector, comprising:

a main body having opposing side walls and including an opening into which a real connector is to be inserted; and a first holding portion and a second holding portion installed respectively on surfaces which face to each other in the opening for holding the real connector by sandwiching from a direction of height of the real connector, wherein side portions of said first and second holding portions are open and spaced apart from said side walls of said main body;

wherein the first holding portion includes a first concave portion for receiving a lock portion installed in the real connector, and the main body includes a second concave portion that adjoins the first concave portion for receiving a lock extending from the lock portion of the real connector.

2. The dummy connector according to claim 1, wherein:

the main body comprises a convex portion to be inserted into an opening portion of a panel installed in a vehicle, and when the convex portion is inserted into the opening portion, the main body is fixed to the panel.

3. The dummy connector according to claim 2, wherein:

the main body comprises a projection portion to be connected to a claw portion of the panel.

4. The dummy connector according to claim 1, wherein:

the first holding portion includes a first concave portion for receiving a lock portion of the real connector so as to hold the real connector when a base portion of the real connector is sandwiched between the first and second holding portion.

5. The dummy connector according to claim 1, wherein:

the real connector comprises a base portion, the base portion comprises several varieties of widths corresponding to different numbers of terminals to be connected to the base portion, and the opening is longer in a long side direction than the maximum width of the several varieties of widths so as to hold the real connector comprising the several varieties of widths.

6. A dummy connector, comprising:

a main body including an opening into which a real connector having a base portion is to be inserted; and a first holding portion and a second holding portion installed respectively on surfaces which face to each other in the opening, and for holding the real connector by sandwiching the real connector in a direction of height of the real connector, wherein side portions of said first and second holding portions are open and spaced apart from said side walls of said main body such that sides of said base portion can extend beyond said side portions, and;

the first holding portion includes a first concave portion for receiving a lock portion of the real connector so as to hold the real connector when said base portion of the real connector is sandwiched between the first and second holding portion;

wherein the main body includes a second concave portion that adjoins the first concave portion for receiving a lock extending from the lock portion of the real connector.

7. The dummy connector according to claim 6, wherein:

the main body comprises a convex portion to be inserted into an opening portion of a panel installed in a vehicle, and when the convex portion is inserted into the opening portion, the main body is fixed to the panel.

8. The dummy connector according to claim 7, wherein:

the main body comprises a projection portion to be connected to a claw portion of the panel.

* * * * *